US007438121B2

(12) United States Patent
Minami et al.

(10) Patent No.: US 7,438,121 B2
(45) Date of Patent: Oct. 21, 2008

(54) HEAT EXCHANGER AND METHOD FOR MANUFACTURING THE SAME

(75) Inventors: Kazuhiko Minami, Oyama (JP); Daishi Tanaka, Oyama (JP); Shintaro Nakagawa, Oyama (JP)

(73) Assignee: Showa Denko K.K., Tokyo (JP)

( * ) Notice: Subject to any disclaimer, the term of this patent is extended or adjusted under 35 U.S.C. 154(b) by 30 days.

(21) Appl. No.: 10/587,173

(22) PCT Filed: Feb. 10, 2005

(86) PCT No.: PCT/JP2005/002533

§ 371 (c)(1),
(2), (4) Date: Jul. 25, 2006

(87) PCT Pub. No.: WO2005/078372

PCT Pub. Date: Aug. 25, 2005

(65) Prior Publication Data

US 2007/0163761 A1 Jul. 19, 2007

Related U.S. Application Data

(60) Provisional application No. 60/545,529, filed on Feb. 19, 2004.

(30) Foreign Application Priority Data

Feb. 12, 2004 (JP) ..... 2004-035356

(51) Int. Cl.
*F28F 19/02* (2006.01)
*B23K 31/02* (2006.01)

(52) U.S. Cl. ..... 165/133; 165/134.1; 228/183

(58) Field of Classification Search ..... 165/133, 165/134.1

See application file for complete search history.

(56) References Cited

U.S. PATENT DOCUMENTS 4,368,776 A * 1/1983 Negita et al. ..... 165/133

(Continued)

FOREIGN PATENT DOCUMENTS

JP 04-015496 1/1992

(Continued)

OTHER PUBLICATIONS

U.S. Appl. No. 10/587,173, filed Jul. 25, 2006, Minami, et al.

(Continued)

*Primary Examiner*—Allen J Flanigan
(74) *Attorney, Agent, or Firm*—Oblon, Spivak, McClelland, Maier & Neustadt, P.C.

(57) ABSTRACT

A method for manufacturing an aluminum heat exchanger includes the steps of: obtaining a heat exchanger tube 2 by forming a Zn thermally sprayed layer on a surface of an aluminum flat tube core so as to adjust Zn adhesion amount to 1 to 10 g/m$^2$; obtaining a heat exchanger core by alternatively arranging the heat exchanger tube 2 and an aluminum fin 3 and brazing the heat exchanger tube and the fin with end portions of the heat exchanger tube connected to aluminum headers in fluid communication; and forming a chemical conversion treatment coat (corrosion resistance coat) on a surface of the heat exchanger core by subjecting the surface of the heat exchanger core to chemical conversion treatment using at least one chemical conversion treatment agent selected from the group consisting of phosphoric acid chromate, chromic acid chromate, phosphoric acid zirconium series, phosphoric acid titanium series, fluoridation zirconium series, and fluoridation titanium series. The obtained heat exchanger has a long last good corrosion resistance and can prevent occurrence of fin detachment and pit corrosion.

13 Claims, 2 Drawing Sheets

U.S. PATENT DOCUMENTS

| | | | | |
|---|---|---|---|---|
| 5,021,106 | A * | 6/1991 | Iwai et al. | 148/437 |
| 5,217,547 | A * | 6/1993 | Ishikawa et al. | 148/552 |
| 6,306,226 | B1 * | 10/2001 | Iino et al. | 148/247 |
| 6,571,864 | B1 * | 6/2003 | Yoon et al. | 165/133 |
| 6,708,869 | B2 * | 3/2004 | Hyogo et al. | 228/183 |
| 6,874,230 | B2 * | 4/2005 | Chikuma et al. | 29/890.046 |
| 2002/0084002 | A1 * | 7/2002 | Hardin et al. | 148/243 |
| 2004/0031598 | A1 * | 2/2004 | Shimanuki et al. | 165/164 |
| 2005/0034793 | A1 * | 2/2005 | Henry et al. | 148/551 |
| 2006/0231170 | A1 * | 10/2006 | Parson et al. | 148/437 |

FOREIGN PATENT DOCUMENTS

| | | | |
|---|---|---|---|
| JP | 04-288494 | | 10/1992 |
| JP | 05071893 | A * | 3/1993 |
| JP | 09-143752 | | 6/1997 |
| JP | 10-263799 | | 10/1998 |
| JP | 11-077292 | | 3/1999 |
| JP | 11-092848 | | 4/1999 |
| JP | 11-131254 | | 5/1999 |
| JP | 2000-204427 | | 7/2000 |
| JP | 2003-130585 | | 5/2003 |

OTHER PUBLICATIONS

U.S. Appl. No. 10/589,190, filed Aug. 11, 2006, Minami, et al.
U.S. Appl. No. 10/584,197, filed Jun. 23, 2006, Minami, et al.
U.S. Appl. No. 10/585,658, filed Jul. 7, 2006, Minami et al.

* cited by examiner

HEAT EXCHANGER AND METHOD FOR MANUFACTURING THE SAME

This application claims priority under 35 U.S.C. §119 to Japanese Patent Application No. 2004-35356 filed on Feb. 12, 2004 and U.S. Provisional Application No. 60/545,529 filed on Feb. 19, 2004, the entire disclosures of which are incorporated herein by reference in their entireties.

CROSS REFERENCE TO RELATED APPLICATIONS

This application is an application filed under 35 U.S.C. §111(a) claiming the benefit pursuant to 35 U.S.C. §119(e)(1) of the filing date of U.S. Provisional Application No. 60/545,529 filed on Feb. 19, 2004, pursuant to 35 U.S.C. §111(b).

TECHNICAL FIELD

The present invention relates to an aluminum heat exchanger for use in, for example, a car air-conditioning refrigerant cycle and a method for manufacturing the same.

In this disclosure, the wording of "aluminum" is used to include the meaning of aluminum and its alloy.

BACKGROUND ART

The following description sets forth the inventor's knowledge of related art and problems therein and should not be construed as an admission of knowledge in the prior art.

As an aluminum heat exchanger for use in a car-air conditioning refrigeration cycle, the so-called multi-flow type or parallel-flow type heat exchanger is well-known, wherein the heat exchanger is provided with a plurality of flat tubes disposed in the thickness direction with a fin interposed therebetween and a pair of hollow headers with the ends thereof connected to the flat tubes in a fluid communication. In such heat exchangers, the fin and/or header is made of an aluminum brazing sheet with clad brazing material, and the entire components of the heat exchanger including the fins and headers are integrally brazed in a furnace in a provisionally assembled manner.

In such aluminum heat exchangers, as technique for improving the corrosion resistance, technique for forming a sacrificial corrosion layer on a heat exchanger tube is generally used.

For example, in the technique disclosed in Japanese Unexamined Laid-open Publication No. H4-15496 (Patent Document 1), Zn is thermally sprayed onto the surface of the heat exchanger tube to form a sacrificial corrosive layer by diffusing the Zn in the surface portion of the tube.

Other than the aforementioned Zn thermal spraying treatment, as disclosed by Japanese Unexamined Laid-open Patent Publication No. H11-131254 (Patent Document 2) and Japanese Patent No. 3,437,023 (Patent Document 3), to improve corrosion resistance, technique for forming an anti-corrosion film by subjecting a surface of an aluminum product such as a heat exchanger to chemical conversion treatment is also employed.

As disclosed in the aforementioned Patent Document 1, in the technique for thermally spraying Zn on the surface of a heat exchanger tube, if the Zn adhering amount is increased at the time of thermally spraying Zn on the surface of the heat exchanging tube, excessive Zn will be diffused in the brazing portion (i.e., fillet), causing preferential corrosion of the fillet. This in turn causes the so-called fin detachment in which a fin is detached from a tube. Accordingly, it is preferable to decrease the Zn adhering amount. However, since the Zn thermal spraying for spraying a low amount of Zn becomes unstable, adhesion amount becomes uneven, resulting in unstable sacrificial corrosion layer throughout the entire sprayed area. As a result, partial corrosion occurs when used for a long time period, causing pit corrosion.

Furthermore, as shown in the aforementioned Patent Documents 2 and 3, in the technology which forms a corrosion resistant coat by chemical conversion treatment on a heat exchanger surface, although a uniform corrosion resistant coat can be formed broadly, the corrosion resistance could not be maintained for a long period of time, and therefore generation of pit corrosion, etc., can not be prevented effectively.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

Other objects and advantages of the present invention will be apparent from the following preferred embodiments.

DISCLOSURE OF INVENTION

The preferred embodiments of the present invention have been developed in view of the above-mentioned and/or other problems in the related art. The preferred embodiments of the present invention can significantly improve upon existing methods and/or apparatuses.

The present invention was made in view of the aforementioned problems, and aims to provide an aluminum heat exchanger and a method for manufacturing the heat exchanger, which can maintain good corrosion resistance for a long period of time and assuredly prevent generation of fin detachment, pit corrosion, etc.

To attain the aforementioned objects, the present invention has the following structure.

[1] A method for manufacturing an aluminum heat exchanger, the method comprising the steps of:

obtaining a heat exchanger tube by forming a Zn thermally sprayed layer on a surface of an aluminum flat tube core so as to adjust Zn adhesion amount to 1 to 10 g/m$^2$;

obtaining a heat exchanger core by alternatively arranging the heat exchanger tube and an aluminum fin and brazing the heat exchanger tube and the fin with end portions of the heat exchanger tube connected to aluminum headers in fluid communication; and forming a chemical conversion treatment coat (corrosion resistance coat) on a surface of the heat exchanger core by subjecting the surface of the heat exchanger core to chemical conversion treatment using at least one chemical conversion treatment agent selected from the group consisting of phosphoric acid chromate, chromic acid chromate, phosphoric acid zirconium series, phosphoric acid titanium series, fluoridation zirconium series, and fluoridation titanium series.

In the manufacture method of this invention, since the Zn adhering amount on the tube is small, large amount of Zn cannot be diffused a fillet. Accordingly, preferential corrosion of the fillet can be prevented, and fin detachment can be prevented assuredly. Furthermore, even if uneven sacrificial corrosion layer is formed due to small amount of Zn thermal spraying, an even corrosion resistant coat can be broadly formed on the core surface by chemical conversion treatment. Therefore, corrosion toward the core components, such as a tube and a fin, can be delayed assuredly, and therefore long last corrosion resistance of the tube, etc., can be attained, and generation of pit corrosion can be prevented effectively. In addition to the above, since corrosion resistance life time can be synergistically prolonged by the corrosion resistant coat and the sacrificial corrosion layer, the durability can further enhanced. As explained above, the sacrificial corrosion layer formed by low Zn thermal spraying and the corrosion resistant coat formed by chemical conversion treatment supplement the mutual faults, and therefore synergic effects can be obtained. As a result, fin detachment or corrosion deterioration such as pit corrosion can be prevented, resulting in long term good corrosion resistance.

In this invention, in the case where the following structure [2] to [9] is employed, the aforementioned effects can be acquired more assuredly.

[2] The method for manufacturing an aluminum heat exchanger as recited in the aforementioned Item 1, wherein chemical etching treatment is performed prior to the chemical conversion treatment to the heat exchanger core.

[3] The method for manufacturing an aluminum heat exchanger as recited in the aforementioned Item 2, wherein acid cleaning treatment using acidic solution is performed as the chemical etching treatment.

[4] The method for manufacturing an aluminum heat exchanger as recited in any one of the aforementioned Items 1 to 3, wherein a Zn adhesion amount of the sprayed layer is adjusted to 2 to 6 $g/m^2$.

[5] The method for manufacturing an aluminum heat exchanger as recited in any one of the aforementioned Items 1 to 4, wherein the chemical conversion treatment is performed by using fluoridation zirconium series chemical conversion treatment agent.

[6] The method for manufacturing an aluminum heat exchanger as recited in the aforementioned Item 5, wherein a Zr adhesion amount in the chemical conversion treatment is adjusted to 30 to 200 $mg/m^2$.

[7] The method for manufacturing an aluminum heat exchanger as recited in any one of the aforementioned Items 1 to 6, wherein the tube core contains Cu: 0.2 to 0.6 mass % and Mn: 0.1 to 2 mass %.

[8] The method for manufacturing an aluminum heat exchanger as recited in any one of the aforementioned Items 1 to 7, wherein the fin is provided with an aluminum fin core, and wherein the fin core contains Zn: 0.8 to 3 mass %.

[9] The method for manufacturing an aluminum heat exchanger as recited in any one of the aforementioned Items 1 to 8, wherein an area rate of a region of a surface of the heat exchanger tube covered with Zn is adjusted to 10 to 90% or more.

In the following heat exchangers as recited in Items [10] and [11], since the heat exchanger obtained by the aforementioned method according to the invention is further specified, the same effects as mentioned above can be obtained.

[10] An aluminum heat exchanger manufactured by the method as recited in any one of the aforementioned Items 1 to 9.

[11] An aluminum heat exchanger provided with a heat exchanger core in which a heat exchanger tube and an aluminum fin are alternatively arranged and brazed each other with end portions of the heat exchanger tube connected to aluminum headers in fluid communication, wherein the heat exchanger tube has a tube core on which a Zn thermally sprayed layer is formed, the Zn adhesion amount being 1 to 10 $g/m^2$, wherein a chemical conversion treatment coat (corrosion resistance coat) is formed on a surface of the heat exchanger core, wherein the chemical conversion treatment coat is made of at least one element selected from the group consisting of phosphoric acid chromate, chromic acid chromate, phosphoric acid zirconium series, phosphoric acid titanium series, fluoridation zirconium series, and fluoridation titanium series.

[12] A refrigeration cycle in which refrigerant compressed by a compressor is condensed by a condenser, the condensed refrigerant is decompressed by a decompression device, the decompressed refrigerant is evaporated by an evaporator and then returned to the compressor, wherein the condenser is constituted by the aluminum heat exchanger as recited in the aforementioned Item 10 or 11.

In this refrigeration cycle, the same functions and effects as mentioned above can be obtained.

Effects of the Invention

As mentioned above, according to the present invention, it is possible to provide an aluminum heat exchanger and the manufacturing method thereof capable of maintaining good corrosion resistance for a long period of time and preventing generation of fin detachment, pit corrosion, etc., assuredly.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BEST MODE FOR CARRYING OUT THE INVENTION

In the following paragraphs, some preferred embodiments of the invention will be described by way of example and not limitation. It should be understood based on this disclosure that various other modifications can be made by those in the art based on these illustrated embodiments.

Figure 1:
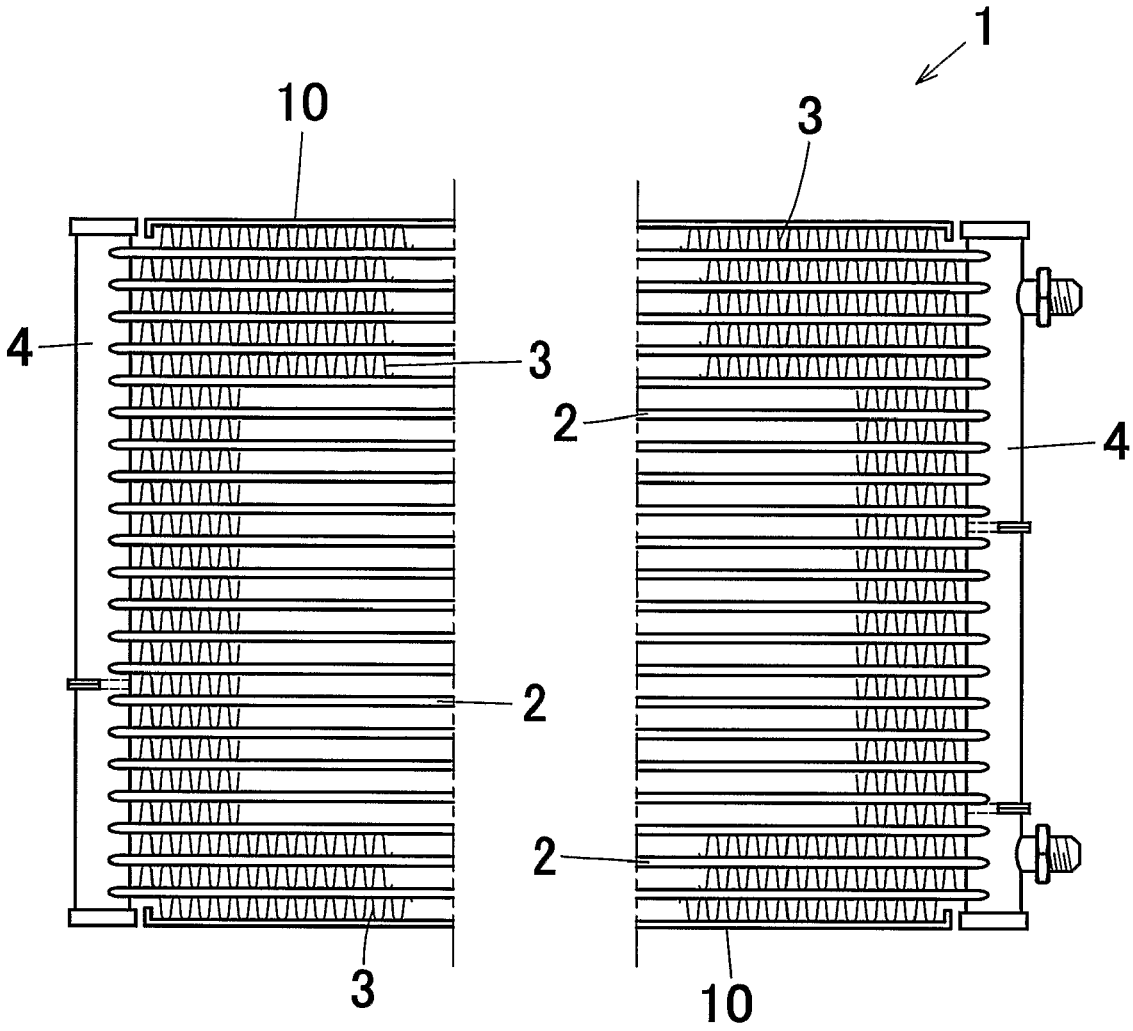
FIG. 1 is a front view showing an aluminum heat exchanger according to an embodiment of the present invention.

FIG. 1 is a front view showing an aluminum heat exchanger 1 according to an embodiment of the present invention. As shown in this figure, this heat exchanger 1 is used as a condenser for use in a refrigeration cycle of a car air-conditioner, and constitutes the so-called multi-flow type heat exchanger.

In this heat exchanger 1, a plurality of flat heat exchanging tubes 2 are horizontally arranged in parallel with their opposite ends connected to a pair of hollow headers 4 vertically disposed in parallel in fluid communication. A corrugated fin 3 is disposed between the adjacent tubes 2 and on the outermost tube 2, and a side plate 10 is arranged on the outside of the outermost corrugated fin 3.

In this heat exchanger 1, the tube 2 is made of aluminum or its alloy (hereinafter simply referred to as "aluminum") on which a small amount of Zn is thermally sprayed, and the fin 3 and the header 4 are made of an aluminum brazing sheet in which brazing material is clad at least on one surface thereof. The tubes 2, the fins 3, the headers 4 and the side plates 10 are provisionally assembled into a heat exchanger assembly, and the provisional heat exchanger assembly is simultaneously brazed in a furnace, thereby manufacturing a heat exchanger core.

The below-mentioned chemical conversion treatment is performed to this heat exchanger core to form a corrosion resistant coat throughout the entire surface.

Figure 2:
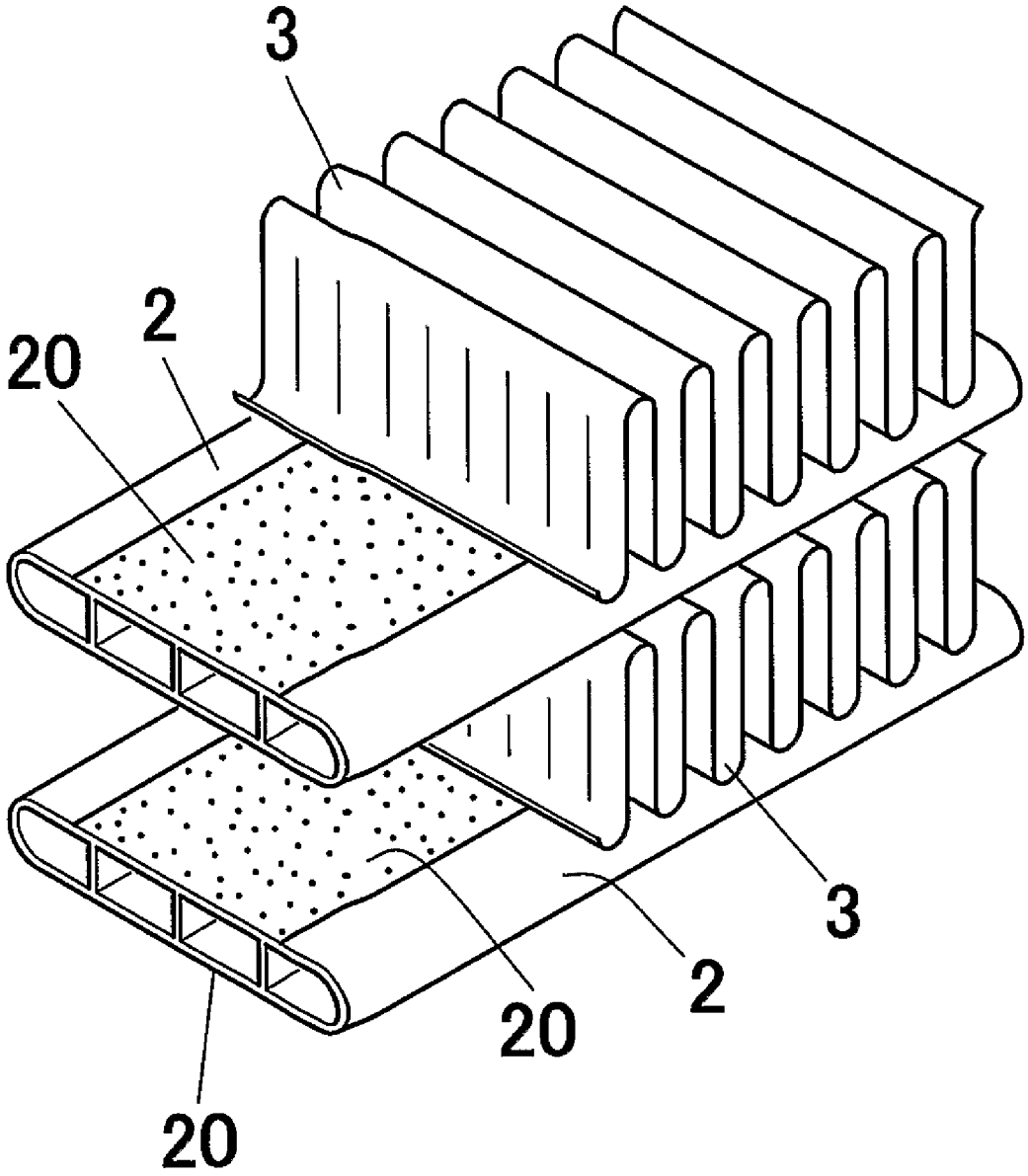
FIG. 2 is a partially enlarged perspective view showing a brazed portion between a tube and a fin in the heat exchanger according to the embodiment of the present invention.

As shown in FIG. 2, the tube 2 includes a tube core made of an aluminum extruded article and a thermally sprayed layer 20 containing Zn formed on at least one surface of the tube core.

As the core material of the tube 2, Al alloy containing Cu and Mn can be preferably used.

In this embodiment, the amount of Cu content in the tube core is preferably adjusted to 0.2 to 0.6 mass % (including the upper and lower limits), more preferably 0.25 to 0.5 mass %. Furthermore, the amount of Mn content is preferably adjusted to 0.1 to 2 mass %, more preferably to 0.1 to 0.5 mass %, or 0.6 to 1.5 mass %. That is, if the Cu or Mn content is too low, the potential of the tube core does not become noble with respect to the vicinity portion thereof. As a result, corrosion toward the core material may quickly advance, resulting in pit corrosion, etc. To the contrary, if the Cu content is excessive, corrosion resistance may deteriorates due to intergranular corrosion of Cu. Furthermore, if the Mn amount is excessive, high temperature and high hardness of the molding material at the time of extruding the tube core arises, resulting in deterioration of workability, such as extruding.

In this embodiment, the tube core is formed by extruding the aforementioned alloy material.

The thermally sprayed layer 20, which functions as a sacrificial corrosion layer, can be formed by making Zn adhere by thermally spraying Zn and making the Zn diffuse in the tube core by the heat at the time of brazing.

Although a method for thermally spraying Zn on the surface of the tube core is not especially limited, an arc thermal spraying method can be preferably employed. For example, it can be preferable to employ a method in which a thermal spraying gun of an arc thermal spraying machine is moved along the tube core, or a method for thermally spraying Zn while rewinding a tube core wound in the shape of a coil. Furthermore, in the case where a tube core is an extruded article, a method in which extrusion and thermal spraying are continuously performed with a thermal spraying gun disposed immediately after an extrusion die. Especially, in the case where extrusion and thermal spraying are performed continuously, manufacturing efficiency can be improved.

The thermally sprayed layer 20 can be formed only on one side of the tube core, or on both sides, the upper and lower surfaces. Needless to say, when forming a thermally sprayed layer 20 on both tube sides, it is preferable to dispose thermal spraying guns at the upper and lower sides of the tube core.

Furthermore, the thermal spraying processing is preferably performed in inactive gas atmosphere (non-oxidizing atmosphere), such as nitrogen gas atmosphere, in order to prevent oxidization of the thermally sprayed layer 20 to be formed on the surface of the aluminum material (tube core) as much as possible.

The Zn adhesion amount on the tube 2 by thermal spraying processing is preferably adjusted so as to fall within the range of 1 to 10 g/m$^2$. If the Zn adhesion amount is too small, there is a possibility that it becomes difficult to form a sufficient sacrificial corrosion layer by the adhered Zn, which makes it difficult to obtain a desired corrosion resistance. On the other hand, if the Zn adhesion amount is excessive, a larger amount of Zn will be diffused in a fillet formed between the tube and the fin, resulting in preferential corrosion of the fillet, which may cause fin detachment.

The ratio of the thermal spraying area to the entire tube surface is preferably set to 10 to 90%, more preferably to 20 to 80%. That is, if the area ratio is too low, the Zn containing area decreases, resulting in insufficient size of sacrificial corrosion layer, which makes it difficult to obtain sacrificial corrosion layer. To the contrary, if it is excessive, a larger amount of Zn will be diffused in a fillet formed between the tube and the fin, resulting in preferential corrosion of the fillet, which may cause fin detachment.

In addition, needless to say, a small amount of other elements may be contained as inevitable impurities at un-influential grade in the thermal spraying metallic material.

On the other hand, the Zn content of the fin core of the corrugated fin 3 is preferably adjusted to 0.8 to 3 mass %, more preferably to 2 to 2.8 mass %. That is, if the Zn content is too small, the potential of the fin core becomes noble with respect to the brazing material, causing preferential fillet corrosion, which in turn results in fin detachment. To the contrary, if the Zn content is excessive, the corrosion resistance of the fin core material itself deteriorates at the early stage, which may cause deterioration of the heat conducting performance.

In this embodiment, using various heat exchanger components, such as heat exchanging tubes 2, corrugated fins 3, hollow headers 4, side plates 10, are fabricated into a provisional heat exchanger assembly. Thereafter, flux is applied to this provisional assembly and dried. Then, the provisional assembly is heated in a heating furnace of nitrogen gas atmosphere to simultaneously braze the components to thereby obtain an integrally brazed heat exchanger core.

Furthermore, in this embodiment, chemical conversion treatment is performed to this heat exchanger core. In the chemical conversion treatment, using at least one chemical conversion treatment agent selected from the group consisting of phosphoric acid chromate, chromic acid chromate, phosphoric acid zirconium series, phosphoric acid titanium series, fluoridation zirconium series and fluoridation titanium series, a chemical conversion treatment coat (corrosion resistant coat) is formed on the surface of the aforementioned heat exchanger core.

For example, the heat exchanger core is dipped into the aforementioned chemical conversion treatment agent, or chemical conversion treatment agent is sprayed onto the surface of the heat exchanger core with a spray (spraying method), to make chemical conversion treatment agent contact on the surface of the heat exchanger core to thereby form a film (chemical conversion treatment coat) of treatment agent component.

In the chemical conversion treatment of this embodiment, considering corrosion resistance and environmental problems, it is preferable to use fluoridation zirconium series falseness treatment agent.

In cases where fluoridation zirconium series falseness treatment agent is used to perform the chemical conversion treatment, it is preferable to adjust the adhering amount of zirconium to 30 to 200 mg/m$^2$, more preferably to 60 to 180 mg/m$^2$. That is, if zirconium adhering amount is too small, sufficient corrosion resistance cannot be secured. To the contrary, if the adhering amount is excessive, effects corresponding to the adhering amount cannot be acquired, which is industrially uneconomical.

In this embodiment, prior to the chemical conversion treatment to the heat exchanger core, it is preferable to perform chemical etching treatment. As such chemical etching treatment, it is preferable to perform acid cleaning treatment using acidic solution. The etching treatment liquid, such as an acidic solution, is made to contact the heat exchange core using a dip coating or spraying method in the same manner as in the aforementioned chemical conversion treatment.

In the heat exchanger of this embodiment obtained in the aforementioned procedure, a corrosion resistant coat by chemical conversion treatment is formed on a heat exchanger core assembled using heat exchanger tubes (low-Zn thermally sprayed tubes ) to which small amount of Zn was thermally sprayed. Therefore, good corrosion resistance can be acquired over a long period of time. That is, since the sacrificial corrosion layer is formed based on the thermally sprayed layer containing small amount of Zn, large amount of Zn will not be diffused in a fillet, which can prevent fin detachment due to preferential corrosion of the fillet. Furthermore; even if some uneven sacrificial corrosion layer is formed due to the low Zn thermal spraying, a uniform corrosion resistant coat can be broadly formed on the core surface by the chemical conversion treatment. As a result, corrosion to core composition articles, such as tubes and fins, can be delayed certainly, and therefore corrosion resistance of the tube, etc., can fully be maintained for a long period of time, and generation of pit corrosion can be prevented effectively. In addition, since corrosion life time can be prolonged by the corrosion resistant coat and sacrificial corrosion layer, durability can be improved dramatically. As explained above, the sacrificial corrosion layer formed by low-Zn thermal spraying and the corrosion resistant coat formed by chemical conversion treatment supplement the mutual faults, and therefore synergic effects can be obtained. As a result, fin detachment or corrosion deterioration such as pit corrosion can be prevented, resulting in long term good corrosion resistance.

EXAMPLE

Hereafter, Examples according to the present invention and Comparative Examples for verifying effects of the invention will be explained.

Example 1

Using extruded material consisting of Al alloy (Cu: 0.4 mass %, Mn: 0.15 mass %, balance being Al), a multi-bored flat tube having a width of 16 mm, a height of 3 mm and a thickness of 0.5 mm was extruded with an extrusion machine. On the other hand, thermal spraying guns of an arc thermal spraying machine were disposed at upper and lower sides of the outlet of the extrusion machine to thermally spraying Zn onto the upper and lower sides of the extruded tube to thereby form thermally sprayed layers. Thereafter, the tube with thermally sprayed layers (tube (heat exchanger tube) was cooled in a cooling bath and rolled into a coil shape.

As shown in the following Table 1, in the aforementioned thermal spraying processing, the Zn adhesion amount was adjusted to 1 g/m$^2$.

Using the aforementioned heat exchanger tubes, a provisionally assembled heat exchanger having the same structure as that of the aforementioned multi-flow type heat exchanger (see FIG. 1) as explained in the aforementioned embodiment was prepared.

Then, slurry in which flux was suspended in water was sprayed onto the provisionally assembled heat exchanger and dried. Thereafter, the heat exchanger assembly was heated in a heating furnace in nitrogen gas atmosphere for 10 minutes at 600° C. to perform integral brazing to thereby obtain a heat exchanger core.

Then, acid cleaning treatment was performed to this heat exchanger core using acid cleaning agent (nitric acid: 10 mass %+sulfuric acid: 5 mass %+iron: 1 mass %, wherein the iron exists as iron salt). Thereafter, chemical conversion treatment was performed using zirconium series chemical conversion treatment agent (fluoridation zirconium series chemical conversion treatment agent). At this time, as the chemical conversion treatment agent, agent in which 100 ppm concentration of zirconium ion was contained in water medium was used. The chemical conversion treatment was performed under the conditions that the aforementioned heat exchanger core was immersed for 90 seconds in a bath that the aforementioned chemical conversion treatment agent was heated to 50° C. Thereafter, the heat exchanger core was fully washed with tap water to obtain a heat exchanger sample of Example 1.

TABLE 1

| Example | Chemical conversion treatment Type of treatment agent | Spraying treatment Zn adhesion amount (g/m$^2$) | SWAAT result | CCT result |
|---|---|---|---|---|
| 1 | Zr fluoride | 1 | ◎ | ◎ |
| 2 | | 2 | ◎ | ◎ |
| 3 | | 4 | ◎ | ◎ |
| 4 | | 6 | ◎ | ◎ |
| 5 | | 8 | ○ | ◎ |
| 6 | | 10 | ○ | ◎ |
| 7 | Ti fluoride | 3 | ◎ | ◎ |
| 8 | | 4 | ◎ | ◎ |
| 9 | | 7 | ○ | ◎ |
| 10 | Cr phosphate | 2 | ◎ | ◎ |
| 11 | | 5 | ◎ | ◎ |
| 12 | | 8 | ○ | ◎ |
| 13 | Cr chromate | 1 | ◎ | ◎ |
| 14 | | 3 | ◎ | ◎ |
| 15 | | 6 | ◎ | ◎ |
| 16 | | 10 | ○ | ◎ |

Zr fluoride: zirconium fluoride series
Ti fluoride: titanium fluoride series
Cr phosphate: chromate phosphate
Cr chromate: chromic acid chromate

Examples 2 to 6

As shown in Table 1, heat exchanger samples were prepared by the same processing as mentioned above, except that the Zn adhesion amount were adjusted to 2, 4, 6, 8, 10 g/m$^2$ during the thermal spraying processing.

Examples 7 to 9

Samples were prepared by the same processing as mentioned above, except that the Zn adhesion amount were adjusted to 3, 4, 7 g/m$^2$ as shown in Table 1 during the thermal spraying processing and that fluoridation titanium series chemical conversion treatment agent was used as chemical conversion treatment agent. The chemical conversion treatment was performed using chemical conversion treatment agent in which 100 ppm concentration of zirconium ion was contained in water medium under the conditions that the aforementioned heat exchanger core was immersed for 90 seconds in a bath that the aforementioned chemical conversion treatment agent was heated to 50° C.

Examples 10 to 12

Samples were prepared by the same processing as mentioned above, except that the Zn adhesion amount were adjusted to 2, 5, 8 g/m$^2$ as shown in Table 1 during the thermal spraying processing and that chromate phosphate agent (Nippon Paint Corp. "ARUSURF 407/47") was used as chemical conversion treatment agent.

Examples 13 to 16

Samples were prepared by the same processing as mentioned above, except that the Zn adhesion amount were adjusted to 1, 3, 6, 10 g/m$^2$ as shown in Table 1 during the thermal spraying processing at chromic acid chromate (Nippon Paint Corp. "ARUSURF 600LN2") was used as chemical conversion treatment agent.

Comparative Example 1

As shown in Table 2 shown below, heat exchanger samples were prepared by the same processing as mentioned above, except that the Zn adhesion amount were adjusted to as low as 0.5 g/m$^2$ during the thermal spraying processing and that fluoridation zirconium series chemical conversion treatment agent was used as chemical conversion treatment agent.

TABLE 2

| Comparative example | Chemical conversion treatment Type of treatment agent | Spraying treatment Zn adhesive amount (g/m$^2$) | SWAAT result | CCT result |
|---|---|---|---|---|
| 1 | Fluoridation Zr | 0.5 | X | X |
| 2 | | 12 | X | ◎ |
| 3 | Cr phosphate | 11 | Δ | ◎ |
| 4 | Cr chromate | — | X | X |
| 5 | — | 3 | X (Penetrated pit corrosion) | X |
| 6 | — | 5 | X (Penetrated pit corrosion) | Δ |
| 7 | — | 12 | X | ◎ |

Fluoridation Zr: fluoridation zirconium series
Cr phosphate: chromate phosphate
Cr chromate: chromic acid chromate Comparative Example 2

As shown in Table 2 shown above, heat exchanger samples were prepared by the same processing as in Example 1 mentioned above, except that the Zn adhesion amount were adjusted to as large as 12 g/m$^2$ during the thermal spraying processing.

Comparative Example 3

As shown in Table 2 shown above, heat exchanger samples were prepared by the same processing as mentioned above, except that the Zn adhesion amount were adjusted to as large as 11 g/m$^2$ during the thermal spraying processing and that the aforementioned chromate phosphate agent was used as chemical conversion treatment agent.

Comparative Example 4

As shown in Table 2 shown above, heat exchanger samples were prepared by the same processing as mentioned above, except that the aforementioned chromate phosphate agent was used as chemical conversion treatment agent without performing thermal spraying processing.

Comparative Example 5

As shown in Table 2 shown above, heat exchanger samples were prepared by the same processing as mentioned above, except that the Zn adhesion amount were adjusted to 3 g/m$^2$ during the thermal spraying processing without performing chemical conversion treatment.

Comparative Example 6

As shown in Table 2 shown above, heat exchanger samples were prepared by the same processing as mentioned above, except that the Zn adhesion amount were adjusted to 5 g/m$^2$ during the thermal spraying processing without performing chemical conversion treatment.

Comparative Example 7

As shown in Table 2 shown above, heat exchanger samples were prepared by the same processing as mentioned above, except that the Zn adhesion amount were adjusted to as large as 12 g/m$^2$ during the thermal spraying processing without performing chemical conversion treatment.

Evaluation Test

The following CCT and SWAAT tests were performed to each heat exchanger sample of the aforementioned examples and a comparative example. ps <CCT (Combined Cycle Corrosion Test)>

A cycle of spraying the corrosion test liquid, 5% NaCl solution, for 2 hours and leaving it in a wet condition for 21 hours was repeated by 180 cycles.

The maximum corrosion depth was measured to each sample and the results were shown as follows: "◎" denotes that the maximum corrosion depth was 150 μm or less; "○" denotes that the maximum corrosion depth was 150 μm or more but less than 200 μm; "Δ" denotes that the maximum corrosion depth was 200 μm or more but less than 250 μm; and "x" denotes that the maximum corrosion depth was 250 μm or more. The results are also shown in Tables 1 and 2.

SWAAT

Synthetic Sea Water Acetic Acid Salt Spray Test

A cycle of spraying the corrosion test liquid by ASTM-D1141 for 0.5 hours and leaving it in a wet condition for 1.5 hours was repeated for 960 hours.

The fin joint remaining rate of each sample after the corrosion rest was measured and the results were shown as follows: "◎" denotes that the fin joint remaining rate after the corrosion test was 95% or more; "○" denotes that the fin joint remaining rate after the corrosion test was 70% or more but less than 95%; "Δ" denotes that the fin joint remaining rate after the corrosion test was 50% or more but less than 70%; and "x" denotes that the fin joint remaining rate after the corrosion test was less than 50%. The results are also shown in Table 1. The fin joint remaining rate after the corrosion test is represented by a percentage of the joining rate of the sample tube and fin after the corrosion test to that of the sample tube and fin before the corrosion test.

As will be apparent from the results shown above, in heat exchangers according to examples of this invention, in the CCT and SWAAT tests, satisfactory results were obtained, and it is understood that they are excellent in corrosion resistance. Especially, in the case where the Zn adhering amount during the spraying processing was adjusted to as low as 6 g/m$^2$ or less, more excellent corrosion resistant was demonstrated.

To the contrary, in the heat exchangers according to comparative examples, at least one of CCT and SWAAT results was not satisfactory, and it was confirmed that they are poor in corrosion resistance. Actually, in the heat exchangers according to comparative examples, it was confirmed that large number of fin detachments and pit corrosion were observed.

INDUSTRIAL APPLICABILITY

This invention can be applied to an aluminum heat exchanger for use in car air-conditioning refrigeration cycle and the method for manufacturing thereof.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example;" and "NB" which means "note well."

The invention claimed is:

1. A method for manufacturing an aluminum heat exchanger, the method comprising the steps of:

providing a heat exchanger tube by forming a Zn thermally sprayed layer on an outer surface of an aluminum flat tube core so as to provide a Zn adhesion amount of 2 to 6 g/m$^2$ covering 10 to 90% of a total area of the outer surface of the aluminum flat tube;

assembling a heat exchanger core by alternately arranging the heat exchanger tube and an aluminum fin and brazing the heat exchanger tube and the fin with end portions of the heat exchanger tube connected in fluid communication to respective aluminum headers; and forming a corrosion resistance coat on a surface of the heat exchanger core by subjecting the surface of the heat exchanger core to chemical conversion treatment using at least one chemical conversion treatment agent selected from the group consisting of phosphoric acid chromate, chromic acid chromate, phosphoric acid zirconium series, phosphoric acid titanium series, fluoridation zirconium series, and fluoridation titanium series.

2. The method for manufacturing an aluminum heat exchanger as recited in claim 1, further comprising performing a chemical etching treatment step prior to the chemical conversion treatment of the heat exchanger core.

3. The method for manufacturing an aluminum heat exchanger as recited in claim 2, wherein said chemical etching treatment comprises acid cleaning treatment using acidic solution.

4. The method for manufacturing an aluminum heat exchanger as recited in claim 1, wherein the chemical conversion treatment is performed by using a fluoridation zirconium series chemical conversion treatment agent.

5. The method for manufacturing an aluminum heat exchanger as recited in claim 4, wherein a Zr adhesion amount in the chemical conversion treatment is in the range of 30 to 200 mg/m$^2$.

6. The method for manufacturing an aluminum heat exchanger as recited in claim 1, wherein the tube core comprises 0.2 to 0.6 mass % of Cu and 0.1 to 2 mass % of Mn.

7. The method for manufacturing an aluminum heat exchanger as recited in claim 1, wherein the fin is provided with an aluminum fin core, and wherein the fin core comprises 0.8 to 3 mass % of Zn.

8. The method for manufacturing an aluminum heat exchanger as recited in claim 1, wherein the providing a heat exchanger tube comprises forming the Zn thermally sprayed layer covering 20 to 80% of the outer surface of the aluminum flat tube.

9. The method for manufacturing an aluminum heat exchanger as recited in claim 5, wherein the Zr adhesion amount is in the range of 60 to 180 mg/m$^2$.

10. The method for manufacturing an aluminum heat exchanger of claim 6, wherein the tube core comprises 0.25 to 0.5 mass % of Cu.

11. The method for manufacturing an aluminum heat exchanger of claim 6, wherein the tube core comprises 0.1 to 0.5 mass % of Mn, or 0.6 to 1.5 mass % of Mn.

12. The method for manufacturing an aluminum heat exchanger as recited in claim 7, wherein the fin core comprises 2 to 2.8 mass % of Zn.

13. The method for manufacturing an aluminum heat exchanger as recited in claim 1, wherein said providing a heat exchanger tube comprises forming the Zn sprayed layer only on substantially planar portions of the aluminum flat tube.

* * * * *